US009493322B1

(12) United States Patent
Lam

(10) Patent No.: US 9,493,322 B1
(45) Date of Patent: Nov. 15, 2016

(54) MANUAL TAPE APPLICATOR

(71) Applicant: Joe Augustine S. T. Lam, Vancouver (CA)

(72) Inventor: Joe Augustine S. T. Lam, Vancouver (CA)

(73) Assignee: LAMUS TECHNOLOGIES INC., Vancouver, BC (CA)

( * ) Notice: Subject to any disclaimer, the term of this patent is extended or adjusted under 35 U.S.C. 154(b) by 0 days.

(21) Appl. No.: 14/710,755

(22) Filed: May 13, 2015

(51) Int. Cl.

| | |
|---|---|
| ***B44C 7/00*** | (2006.01) |
| ***B29C 65/00*** | (2006.01) |
| ***B65H 35/00*** | (2006.01) |
| ***B65H 37/00*** | (2006.01) |

(52) U.S. Cl.
CPC ..... *B65H 35/0033* (2013.01); *B65H 35/0026* (2013.01); *B65H 37/005* (2013.01); *B65H 2301/443* (2013.01); *B65H 2301/44338* (2013.01)

(58) Field of Classification Search
CPC ..... B65H 37/005; B65H 35/008; B65H 35/0086; B65H 35/0066; B65H 35/0033; B65H 35/0026; B65H 2301/44338; B65H 2301/443; B65H 35/0073
See application file for complete search history.

(56) References Cited

U.S. PATENT DOCUMENTS

| | | | | |
|---|---|---|---|---|
| 2,264,425 | A | 12/1941 | Witter | |
| 2,434,776 | A | 1/1948 | Van Cleef et al. | |
| 2,506,504 | A | 5/1950 | Hudson | |
| 2,582,979 | A | 1/1952 | Fritzinger | |
| 3,523,053 | A | 8/1970 | Zbinden et at | |
| 3,813,275 | A | 5/1974 | Weick et al. | |
| 4,238,271 | A | 12/1980 | Urushizaki | |
| 4,253,905 | A | 3/1981 | Regan | |
| 4,345,966 | A | 8/1982 | Iiyama et al. | |
| 4,762,586 | A | 8/1988 | Wilkie | |
| 5,236,540 | A * | 8/1993 | Shi | B65H 35/0033 156/523 |
| 5,288,362 | A * | 2/1994 | Shuh-Chin | B65H 35/0033 156/523 |
| 5,641,377 | A | 6/1997 | Chung | |
| 6,152,344 | A | 11/2000 | Jensen | |
| 6,799,623 | B1 | 10/2004 | Cheng | |
| 7,669,631 | B2 | 3/2010 | Balley et al. | |
| 8,393,375 | B2 | 3/2013 | Lam | |
| 8,800,630 | B1 | 8/2014 | Albanese et al. | |
| 2010/0175836 | A1* | 7/2010 | Lam | B65H 35/0013 156/468 |
| 2011/0297322 | A1* | 12/2011 | Lam | B65B 51/067 156/361 |

OTHER PUBLICATIONS

U.S. Appl. No. 14/624,895, filed Feb. 18, 2015, Lam.
International Search Report PCT/CA2016/050038 dated Apr. 21, 2016.
Written Opinion for PCT/CA2016/050038 dated Apr. 20, 2016.

* cited by examiner

*Primary Examiner* — Alex Efta

(57) ABSTRACT

An improved manually operated taping device provides for control of the leading end or a tape being applied, which may be obtained by a brake action of adhesive grip or both and may also include controlled tape cutting action and a safety cutting knife retaining mechanism.

5 Claims, 2 Drawing Sheets

MANUAL TAPE APPLICATOR

FIELD OF INVENTION

The present invention relates to manual taping devices, more particular to an improved device that facilitates performance of the manual taping operation.

BACKGROUND OF THE PRESENT INVENTION

There are many different hand operated tape applicators, for example, U.S. Pat. No. 2,582,979 issued Jan. 22, 1952 to Fritzinger; U.S. Pat. No. 3,523,053 issued Aug. 4, 1970 to Zbinden et al; U.S. Pat. No. 3,813,275 issued May 28, 1974 to Weick et al.; U.S. Pat. No. 4,238,271 issued Dec. 9, 1980 to Urushizaki; U.S. Pat. No. 4,253,905 issued Mar. 3, 1981 to Regan; U.S. Pat. No. 4,345,966 issued Aug. 24, 1982 to Iiyoma et al.; U.S. Pat. No. 4,762,586 issued Aug. 9, 1988 to Wilkie; U.S. Pat. No. 5,641,377 issued Jun. 24, 1997 inventor Chung and U.S. Pat. No. 6,799,623 issued Oct. 5, 2005 to Cheng; U.S. Pat. No. 7,669,631 issued Mar. 2, 2010, inventor Bailey and Applicant's co-pending application Ser. No. 14/624,895 filed Feb. 18, 2015 by Lam (the same inventor as the instant application.

Essentially all such manual tapers when operated provide a relatively long free leading end portion that is to be applied to the next object to be taped. Normally these conventional hand operated tapers or so call tape dispensers require the operator to pull the free leading end portion with his fingers and then attach it onto the object to initiate the taping process. A cutting knife is also required since the tape is supplied as a continuous ribbon from a supply source that is normally a roll of such tape mounted on the applicator. The knife is usually positioned away from the tape path and the object to avoid accidental tape cut off or damaging the object during the taping process. In many cases a safety guard for the knife is provided to prevent operator injuries. See for example U.S. Pat. No. 5,641,377 which discloses a knife that retracts from its normal cutting position for safety purpose. U.S. Pat. No. 7,669,631 relates to limiting snap back of the free leading end of the tape.

In some manually activated tape dispensing devices the cutting operation is manually initiated by some form of triggering operation which presents the tape to the cutting blade to thereby sever the tape see U.S. Pat. Nos. 4,762,586; 4,345,966; 4,253,905; and 3,813,275.

The patents to U.S. Pat. Nos. 4,345,966 and 3,813,275 together with U.S. Pat. Nos. 4,238,271; 3,523,053; and U.S. Pat. No. 2,582,979 to Fritzinger provide some form of withdraw system to move the free end of the tape away from the point of application, in most cases by physically moving the tape roll etc.

These device disclosed in the referenced patents rely solely on manual dexterity of the operator to move the device in the taping operation and/or in many cases to trigger tape cut-off to complete the operation.

BRIEF DESCRIPTION OF THE PRESENT INVENTION

It is the main an object of the present invention to provide an improved manually operated taping device that is easy and safe to use and maintains control of the leading end of the tape on the device.

It is another object of this invention to provide a cutting knife safety feature that requires tape tension to release the cutting edge from a retracted position It is further object of the present invention to provide a manually operated taping device that applies a releasable brake the tape during the cutting operation to better ensure a cleaner cut.

It is another object of the present invention to provide a manually operated taping device which includes guides to hold the tape in position relative to the tape applying wiper.

Broadly the present invention relates to a manual tape applicator comprising a main frame, at least one guide roll mounted on said main frame for rotation on a first axis to guide a tape having an adhesive side and a non-adhesive side from a supply of said tape toward a tape applicator wiper mounted on a wiper assembly that is pivotably mounted on said main frame on a second axis, movement about said second axis moving said applicator wiper between an extended inactive position to a retracted cutting position, means biasing said wiper assembly and thereby said applicator wiper to said extended inactive position, a cutter assembly pivotably mounted on said main frame on a third axis, a top wiper mounted on and extending from said cutter assembly and a cutter blade mounted on said cutter assembly, a latch cam element extending from said cutter assembly and a cooperating cam on said wiper assembly, said latch and cooperating cams interacting to prevent movement of said cutter assembly when said applicator wiper is in said extended inactive position and freeing said cutter assembly for pivotal movement on said third axis when said applicator wiper is moved at least partway between said extended and said retracted positions, said first and second and third axes being parallel.

Preferably said latch cam comprises a cam element connected to said cutter assembly by an arm and said cooperating cam comprises a slot with a notch formed in said wiper assembly in which said cam element is received.

Preferably said latch cam and said cooperating cam have adjacent edges positioned to interact and prevent movement of said applicator assembly toward said retracted position until released by movement of said top wiper disengages said edges.

Preferably said applicator wiper extends between a first end adjacent to said at least one guide roll and a free end, said at least one guide roll being a braking guide roll, said first end being on the side of said second axis adjacent to said breaking guide roll, said one end being spaced from said breaking guide roll when said applicator wiper is in said extended position and being pressed toward said breaking guide roll to clamp said tape between said breaking guide roll and said one end said when said applicator wiper is in said retracted position.

Preferably said applicator wiper extends between a first end adjacent to said at least one guide roll and a free end, said first end being on the side of said second axis adjacent to said at least one guide roll and said free end on the opposite side of said second axis, a pair of opposed tabs mounted from said frame and positioned one adjacent to each side of said applicator wiper between said second axis and said free end, and each said tab overlapping an adjacent side edge of said tape, said tabs being positioned so that when said applicator wiper is in said extended position said tabs are pressed against said adhesive side of said tape and said tabs and said tape separate as said applicator wiper move toward said retracted position.

Preferably said applicator wiper is wider adjacent to said free end that adjacent to said first end to provide a narrow portion extending at least one half the length of said applicator wiper between said one and said free ends, said tabs being adjacent to said narrow portion of said applicator wiper, and each said tab overlaps with an adjacent side edge of said tape but does not overlap with said applicator wiper, said tabs being positioned so that when said applicator wiper is in said extended position said tabs are pressed against said adhesive side of said tape and said tabs and said tape separate as said applicator wiper move toward said retracted position.

BRIEF DESCRIPTION OF THE SEVERAL VIEWS OF THE DRAWINGS

Further features, objects and advantages will be evident from the following detailed description of the preferred embodiments of the present invention taken in conjunction with the accompanying drawings in which.

DETAILED DESCRIPTION OF THE INVENTION

Figure 1:
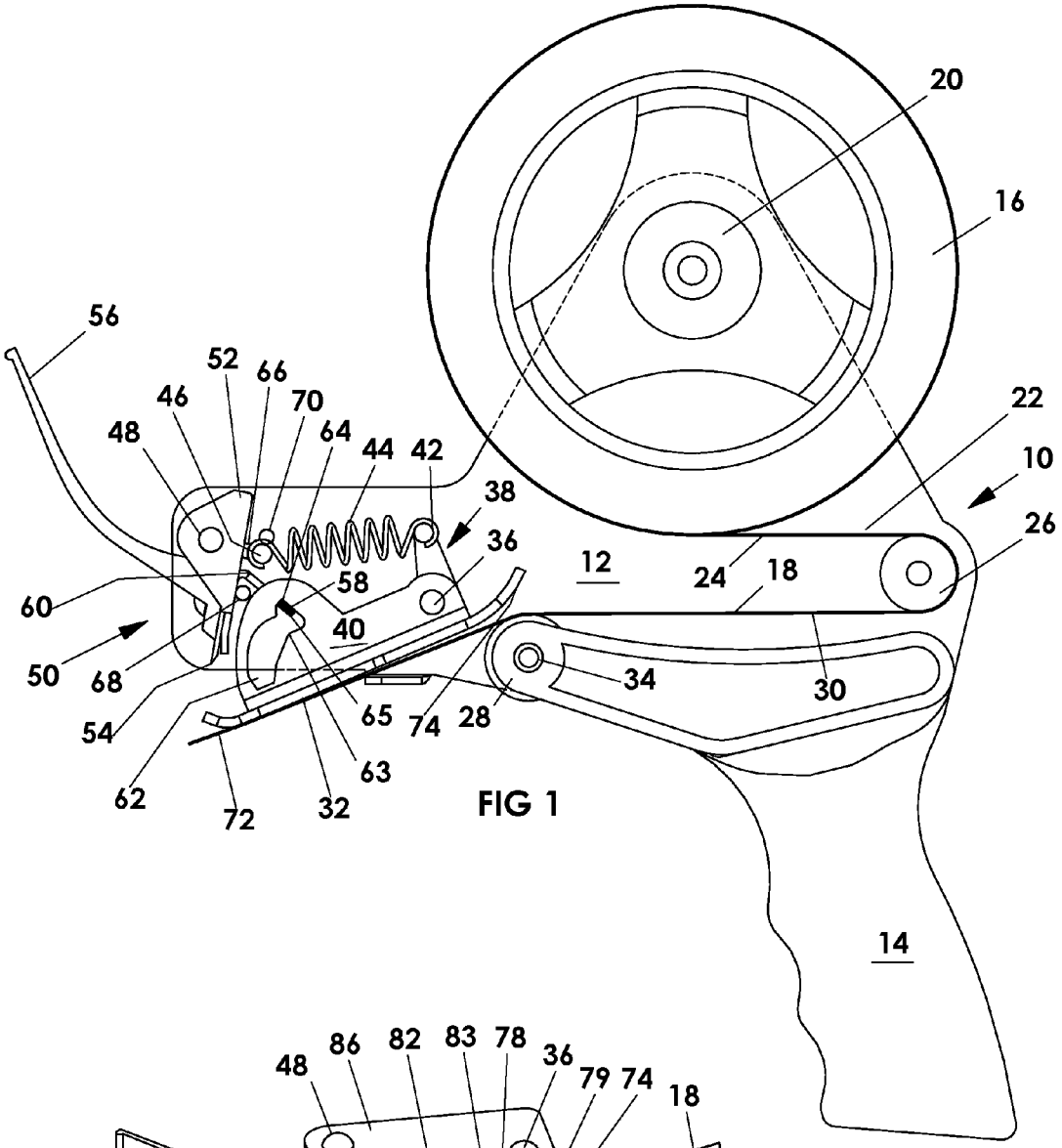
FIG. 1 is a side elevation of the present invention with parts omitted for clarity.

FIG. 1 shows the manual tape applicator 10 of the present invention that comprises a main frame 12 with a handle 14 projecting there from in a position to be grasped by an operator when using the device. A tape roll 16 which provides the supply of tape 18 to be applied by the applicator 10 is mounted on the frame 12 in the normal manner as indicated at 20. The tape 18 has an adhesive or sticky side 22 and a non-adhesive side 24. The tape 18 passes over the guide rolls 26 and 28 which define a portion of tape path 30 leading from the tape roll 16 to the applicator wiper 32. As will be described below the guide roll 28 also functions as braking guide roll 28 and is mounted for rotation on an axel that defines first axis 34.

Figure 2:
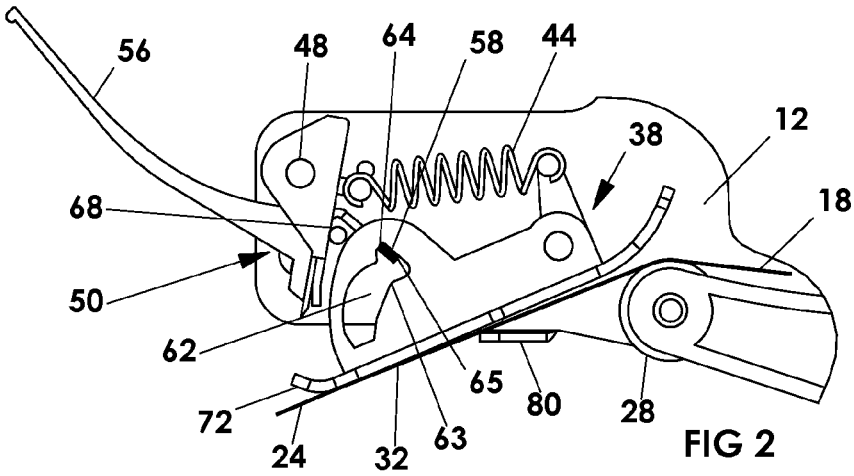
FIG. 2 is a partial view similar to FIG. 1 showing the applicator wiper in extended position and pressing the tape between the positioning tabs and applicator wiper to hold the tape in position adjacent to the applicator wiper and the cutoff assembly in latched position.

Mounted on the main frame 12 for rotation on a second axel that defines a second axis 36 is a applicator assembly 38 composed of an applicator frame 40 to which the applicator wiper 32 is attached and that includes an arm 42 which is connect via a spring 44 to a pin 46 mounted on the frame 52 of the cutter assembly 50 as will be described below. The spring 44 biases the assembly 38 to rotate counter clockwise on the axis 36 in the illustration of FIGS. 1, 2, 3 and 4 and move the applicator wiper 32 to its extended position as shown in FIGS. 1 and 2. Also mounted on the main frame 12 for rotation about a third axel that defines a third axis 48 is a cutter assembly 50 which is composed of a cutter frame 52 to which is mounted the cutter or cutter blade 54 and a top wiper 56. A latch cam 58 is mounted on an arm 60 that extends from the frame 52. The latch cam 58 engages with a cooperating cam 62 which is in the form of a shaped slot extending though the applicator frame 40. The slot or cam 62 has a laterally extending notch 64 at the end of the slot or cam 62 adjacent to the second axel 36 into which the latch cam 58 is received when the applicator wiper 32 is in extended position as shown in FIGS. 1 and 2. In this position movement of the cutter assembly 50 is prohibited so that it is essentially held in position when the latch cam is in the notch 64. The cam 62 provides a lower surface that cooperates with the adjacent edge 65 of the cam 58 to stop clockwise movement of the applicator assembly 38 as will be described below.

As above indicated the one end of spring 44 is connected to the pin 46. The pin 46 is mounted to the cutoff frame 52 via an arm 66 that connects to the frame 52 slightly offset from the second axis 48 so the cutter assembly is urged to turn counterclockwise in the views shown for example in FIGS. 1 and 2 which holds the cutoff assembly 50 against the stop 68 projecting from the main frame 12. A second stop 70 that also projects from the main frame 12 limits movement of the cutoff assembly 50 in the clockwise direction as shown for example in FIGS. 1 and 2.

It will be apparent from FIGS. 1 and 2 that when the cutoff assembly is forced against the stop 68 by the spring 44 and the applicator assembly 38 i.e. the applicator wiper 32 is in extended position the latch cam 58 is received in the notch 64 of the cooperating cam 62 to prevent movement of the cutoff assembly 50.

Figure 1A:
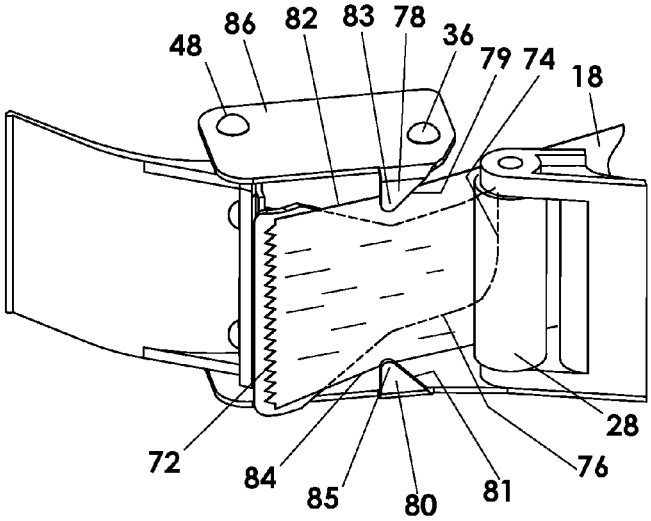
FIG. 1*a* is a view looking up form below the invention as shown in FIG. 1 showing the positioning tabs to hold the tape adjacent to the applicator wiper.

As shown in FIG. 1*a* the applicator wiper 32 has a first end 74 adjacent to the braking guide roll and a free end 72 end adjacent to the cutoff assembly 50. The wiper 32 is wider adjacent to its free end 72 than at its first end 74 to provide a narrow portion 76 that extends for a significant portion (preferably more than one half) the length of the wiper 32 from the first end 74 toward the free end 72. The first end 74 is on the side of the axis 36 adjacent to the braking guide roll 28 and the free end 72 on the opposite side of the axis 36.

A pair of opposed tabs 78 and 80 extend in from the periphery or side edges 82 and 84 of the tape 18 to overlap with their adjacent side edge 82 and 84 in the area where the side edges 82 and 84 are not supported by the applicator wiper 32 i.e. the tabs 78 and 80 are located on opposite sides of the narrow portion 76 and in the illustrated version do not extend across the tape to overlap with the narrow portion 76.

The tab 80 is fixed directly to the main frame 12 however the tab 78 opposite the tab 80 is connected to and projects from a plate or panel 86 that is mounted on the free ends (ends remote from the main frame 12) of the axels 36 and 48. Both the tabs 78 and 80 have their trailing edges (in the direction of tape movement) 79 and 81 respectively sloped in the direction of movement so that the free ends 83 and 85 are adjacent to the e a downstream end of the tabs. This shape facilitates threading a tape so that edges 82 may be position as shown i.e. between the tabs 78 and 80 and the applicator assembly 38 with the adhesive side 22 of the tape 18 facing the tabs 78 and 80.

Figure 3:
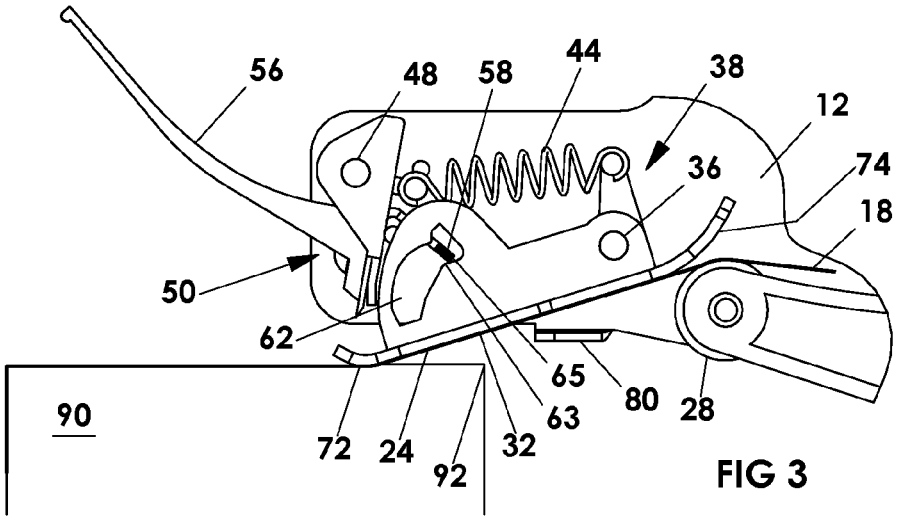
FIG. 3 is a partial view similar to FIG. 2 but with the applicator wiper moved toward the retracted position and is in a position wherein the tape is no longer pressed against the tabs i.e. the tape is free to be pulled from the tape source and be applied and the cutoff assembly in unlatched position.
Figure 4:
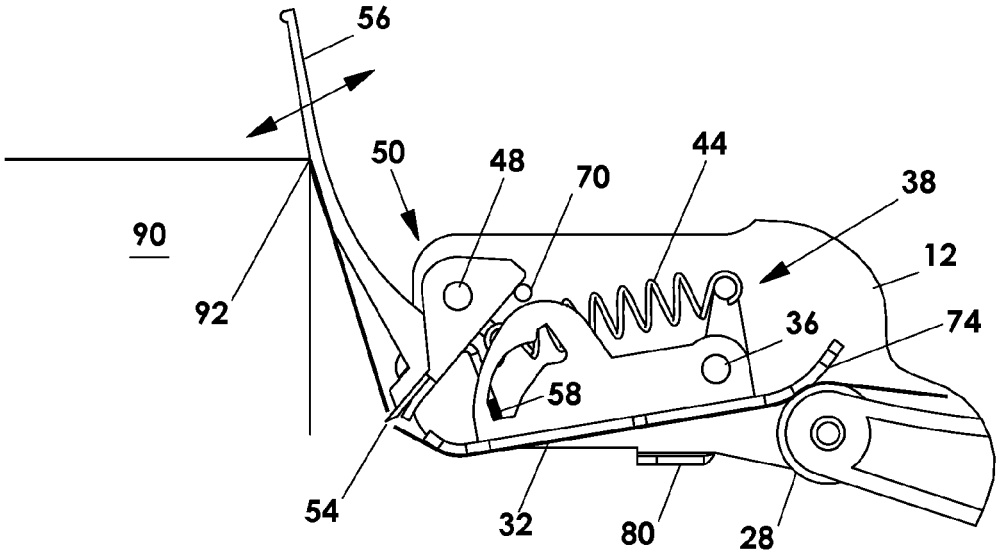
FIG. 4 is a partial view similar to FIG. 2 but with the applicator wiper moved into retracted position and is in a position wherein the tape is clamped between the guide roll and the adjacent end of the applicator wiper to facilitate cutting and the cutoff assembly is in cutting position and the tape is free of the positioning tabs.

As above described the tape 18 is drawn from the roll 16 passes around roll 26 and over roll 28 and onto applicator wiper 32 which is used to apply the tape 18 to a box or the like 90 (see FIGS. 3 and 4).

When not in use or at the start of the taping operation the various part of the device 10 are in the positions shown in FIG. 2 i.e. the applicator wiper 32 is in extended position, the latch cam 58 is received in the notch 64 in the cam 62 to prevent movement of the cutoff assembly 50 from the stop 68 against which it is position and biased there against by the spring 44. In this position the tabs 78 and 80 (only 80 shown) contact the adhesive side 24 of the tape 18 to hold the tape 18 in position.

At the beginning of the taping operation the application assembly 38 and the applicator wiper 32 are displaced from the extended position and move to the positions illustrated in FIG. 3 in which the device 10 will normally remain as the tape is being applied. In this position the latch cam 58 has been moved out of the notch 64 thereby freeing the cutoff assembly 50 to move, but it is held against the stop 68 by the spring 44 and engagement of the edge 65 of the cam 58 with the lower edge 63 of the cam 62 i.e. the adjacent edges 63 and 65 engage preventing further movement of applicator assembly 38. Also the tape 18 (which tends to move with the applicator wiper 32) is separated from the tabs 78 and 80 to free the tape 18 and permit it to be freely dispensed during application to the box or the like 90.

When the box or the like 90 has been taped the operation is completed by severing the tape 18 as shown in FIG. 4. This is accomplished by pressing the top wiper 56 generally against the adjacent corner 92 of the box or the like 90 which moves the top wiper 56 and thereby the cutoff assembly 50 against the stop 70 and the cutter 54 into cutting position. The movement of the top wiper 56 causes the lower edge 65 of latch cam 58 to slide away from engagement with lower edge 63 of the cam 62 her which frees the applicator assembly 38 for further movement in the clockwise direction. At the same time the tension in tape 18 generated by movement of the device 10 forces the applicator assembly 38 to rotate clockwise and thereby move the applicator wiper 32 to retracted position with the free end 72 of the wiper 32 moved to a position immediately adjacent to the cutter 54 to minimize the distance between the cutter 54 and the free end 72 which facilitates the cutting of the tape 18 and wherein the end 74 of the applicator wiper 32 adjacent to the roll 28 moved to press the tape against the roll 28 to in effect prevent further movement of the tape 18. (i.e. the end 74 is on the side of the axel or axis 36 adjacent to the braking guide roll 28 so clockwise movement of the assembly 38 forces the end 74 against the tape to clam same between the end 74 and roll 28).

Having described the invention, modifications will be evident to those skilled in the art without departing from the scope of the invention as defined in the appended claims, for example the wiper 32 may be replaced by a roller mounted on the applicator assembly where the free end of the applicator 38 is positioned in the illustrated embodiments and used to apply the tape 18. Obviously if this is done and a brake is to be provided an element similar to the end 74 must be provided to cooperate with the roll 28 in the same way the end 74 cooperates to provide the brake.

The invention claimed is:

1. A manual tape applicator comprising a main frame, at least one guide roll mounted on said main frame for rotation on a first axis to guide a tape having an adhesive side and a non-adhesive side from a supply of said tape toward a tape applicator wiper mounted on a wiper assembly that is pivotably mounted on said main frame on a second axis, movement about said second axis moving said applicator wiper between an extended inactive position to a retracted cutting position, means biasing said wiper assembly and thereby said applicator wiper to said extended inactive position, a cutter assembly pivotably mounted on said main frame on a third axis, a top wiper mounted on and extending from said cutter assembly and a cutter blade mounted on said cutter assembly, a latch cam element extending from said cutter assembly and a cooperating cam on said wiper assembly, said latch cam comprises a cam element connected to said cutter assembly and said cooperating cam comprises a slot with a notch formed in said wiper assembly in which said cam element is received, said latch and cooperating cams interacting to prevent movement of said cutter assembly when said applicator wiper is in said extended inactive position and freeing said cutter assembly for pivotal movement on said third axis when said applicator wiper is moved at least partway between said extended and said retracted positions, said first and second and third axes being parallel.

2. The manual tape applicator as defined in claim 1 wherein said latch cam and said cooperating cam have adjacent edges positioned to interact and prevent movement of said wiper assembly toward said retracted position until released by movement of said top wiper disengaging said edges.

3. The manual tape applicator as defined in claim 1 wherein said applicator wiper extends between a first end adjacent to said at least one guide roll and a free end, said at least one guide roll being a braking guide roll, said first end being on a side of said second axis adjacent to said breaking guide roll, said first end being spaced from said breaking guide roll when said applicator wiper is in said extended position and being pressed toward said breaking guide roll to clamp said tape between said breaking guide roll and said first end said when said applicator wiper is in said retracted position.

4. The manual tape applicator as defined in claim 2 wherein said applicator wiper extends between a first end adjacent to said at least one guide roll and a free end, said at least one guide roll being a braking guide roll, said first end being on a side of said second axis adjacent to said breaking guide roll, said first end being spaced from said breaking guide roll when said applicator wiper is in said extended position and being pressed toward said breaking guide roll to clamp said tape between said breaking guide roll and said first end said when said applicator wiper is in said retracted position.

5. A manual tape applicator comprising a frame, at least one guide roll mounted on said frame for rotation on a first axis to guide a tape having an adhesive side and a non-adhesive side from a supply of said tape toward a tape applicator wiper mounted on a wiper assembly that is pivotably mounted on said frame on a second axis, movement about said second axis moving said applicator wiper between an extended inactive position to a retracted cutting position, means biasing said wiper assembly and thereby said applicator wiper to said extended inactive position, said at least one guide roll being a braking guide roll, said applicator wiper extending between a first end adjacent to said braking guide roll and a free end, said first end being on a side of said second axis adjacent to said braking guide roll and said free end on an opposite side of said second axis, said first end being spaced from said braking guide roll when said applicator wiper is in said extended position and being pressed toward said breaking guide roll to clamp said tape between said braking guide roll and said first end when said applicator wiper is in said retracted position.

* * * * *